US008201273B2

(12) United States Patent
Duncan

(10) Patent No.: US 8,201,273 B2
(45) Date of Patent: Jun. 19, 2012

(54) PROTECTIVE HOOD

(75) Inventor: Paul David Duncan, Matthews, NC (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 742 days.

(21) Appl. No.: 12/273,261

(22) Filed: Nov. 18, 2008

(65) Prior Publication Data

US 2009/0144884 A1 Jun. 11, 2009

(51) Int. Cl.
*A42B 1/06* (2006.01)
*A42B 3/28* (2006.01)

(52) U.S. Cl. ..... 2/202; 2/410; 2/205

(58) Field of Classification Search ..... 2/202, 410, 2/417, 423, 424, 203, 204, 205, 172, 173, 2/84, 8.2, 8.6, 209.13; 128/201.17, 201.15, 128/201.22–201.24, 201.29, 201.25
See application file for complete search history.

(56) References Cited

U.S. PATENT DOCUMENTS 2,448,021 A * 8/1948 De Grazia ..... 2/205
2,800,901 A * 7/1957 Monro ..... 128/201.15
2,821,192 A * 1/1958 Monro ..... 128/201.15
3,058,463 A * 10/1962 Goodrich, Jr. ..... 128/863
4,236,514 A * 12/1980 Moretti ..... 128/201.23
4,583,535 A * 4/1986 Saffo ..... 128/201.25
4,619,254 A * 10/1986 Moretti et al. ..... 128/201.23
H863 H 1/1991 Kwiedorowicz et al.
5,088,115 A * 2/1992 Napolitano ..... 2/69
5,090,054 A 2/1992 Grilliot et al.
5,181,506 A 1/1993 Tardiff, Jr. et al.
5,309,574 A 5/1994 Balaban et al.
5,309,901 A 5/1994 Beaussant
5,369,809 A 12/1994 Hall
5,431,156 A 7/1995 Sundstrom
5,628,065 A 5/1997 Austin
5,690,095 A 11/1997 Glynn et al.
5,704,068 A * 1/1998 Martin ..... 2/173
5,724,958 A 3/1998 Farnworth et al.
5,765,230 A 6/1998 Sivret et al.
5,822,800 A 10/1998 Anderson
5,875,493 A 3/1999 MacDonald et al.
5,981,314 A 11/1999 Glenn et al.
6,006,360 A 12/1999 Reed
6,023,787 A 2/2000 French et al.
6,088,838 A 7/2000 Sontag
6,158,429 A 12/2000 Gardner et al.
6,340,024 B1 1/2002 Brookman et al.
6,370,692 B1 4/2002 Duyn et al.
6,374,418 B1 4/2002 Rindle
6,442,763 B1 9/2002 Larson et al.
6,478,025 B1 11/2002 Yort et al.
(Continued)

*Primary Examiner* — Amy Vanatta
(74) *Attorney, Agent, or Firm* — Dean Small; The Small Patent Law Group

(57) ABSTRACT

A protective hood is provided for protecting a wearer's head from environmental elements. The protective hood includes a hood body having a cap section positioned to fit over a top of the wearer's head, side sections positioned to hang adjacent sides of the wearer's head, and a back section positioned to hang adjacent a back of the wearer's head. The hood body defines an interior space for receiving the wearer's head. An outlet is provided for exhausting gas from the interior space of the hood body. The outlet includes a channel defined by first and second portions of the hood body. The channel is in fluid communication with the interior space and includes an open end portion in fluid communication with the environment for exhausting gas from the channel into the environment.

17 Claims, 7 Drawing Sheets

U.S. PATENT DOCUMENTS

| | | | | |
|---|---|---|---|---|
| 6,578,572 | B2 | 6/2003 | Tischer et al. | |
| 6,654,963 | B2 | 12/2003 | Fayle et al. | |
| 6,754,909 | B1 | 6/2004 | Samelian | |
| 6,829,784 | B2 * | 12/2004 | Austin | 2/7 |
| 6,892,725 | B2 | 5/2005 | Frund | |
| 6,895,960 | B2 | 5/2005 | Fabin | |
| 6,948,191 | B2 | 9/2005 | Avery et al. | |
| 6,957,653 | B2 | 10/2005 | Campbell et al. | |
| 6,997,179 | B1 | 2/2006 | Niemann | |
| 7,200,874 | B2 | 4/2007 | Leguenec | |
| 2003/0075174 | A1 | 4/2003 | Shahaf | |
| 2003/0131846 | A1 | 7/2003 | Campbell et al. | |
| 2005/0028242 | A1 | 2/2005 | Thomas et al. | |
| 2005/0061317 | A1 * | 3/2005 | King | 128/201.22 |
| 2005/0103335 | A1 | 5/2005 | Fabin | |
| 2005/0108804 | A1 | 5/2005 | Bush | |
| 2005/0241045 | A1 | 11/2005 | Tolton | |
| 2006/0004877 | A1 | 1/2006 | Ishikawa et al. | |

* cited by examiner

PROTECTIVE HOOD

BACKGROUND OF THE INVENTION

The subject matter described and/or illustrated herein relates generally to protective hoods, and more particularly, to protective hoods for protecting a wearer against hazardous environmental elements. The entire disclosure of application Ser. No. 12/001,572, filed Dec. 11, 2007, titled "PROTECTIVE HOOD" is hereby incorporated by reference herein in its entirety.

Firefighters, rescue workers, civilians, and others working in chemical, biological, nuclear, and other environments sometimes use protective hoods to protect their heads from chemical, biological, radiological, nuclear, or other contaminants that may be present in the environment. A protective hood typically includes a protective head covering that is capable of being attached to a source of breathing air (such as, but not limited to, a powered air-purifying respirator (PAPR) and/or a pressurized air supply). The protective hood may include an outlet that enables gas, including air that has been breathed and any air that has not been breathed, to be expelled from an interior space of the protective hood. If no outlet is provided, gas will typically be expelled from the interior space through a neck opening of the protective hood. However, a neck seal assembly that partially seals the protective hood with the wearer's neck may restrict the flow of gas out of the interior space and thereby cause an overpressure within the interior space that may be uncomfortable for the wearer.

At least some known outlets for protective hoods are elastomeric flapper valves. Although elastomeric flapper valves enable gas to be expelled from the interior space of the protective hood without creating an overpressure within the interior space, the extra raw material and installation labor costs of elastomeric flapper valves may increase the cost of the protective hood. At least some other known protective hoods include one or more holes in the protective head covering to enable gas to be expelled from the interior space. Although less expensive, contaminated ambient gas may leak into the interior space of the protective hood through the outlet openings during movement and/or inhalation of the wearer. Moreover, some movements of the wearer may compress the interior space of the protective hood. Re-expansion of the protective hood may draw contaminated ambient gas through the outlet openings and into the interior space of the protective hood.

There is a need for a protective hood having an outlet that is less expensive than at least some known protective hood outlets and/or that prevents contaminated ambient gas from entering an interior space of the protective hood through the outlet.

BRIEF DESCRIPTION OF THE INVENTION

In one embodiment, a protective hood is provided for protecting a wearer's head from environmental elements. The protective hood includes a hood body having a cap section positioned to fit over a top of the wearer's head, side sections positioned to hang adjacent sides of the wearer's head, and a back section positioned to hang adjacent a back of the wearer's head. The hood body defines an interior space for receiving the wearer's head. An outlet is provided for exhausting gas from the interior space of the hood body. The outlet includes a channel defined by first and second portions of the hood body. The channel is in fluid communication with the interior space and includes an open end portion in fluid communication with the environment for exhausting gas from the channel into the environment.

In another embodiment, a protective hood is provided for protecting a wearer's head from environmental elements. The protective hood includes a hood body having a cap section positioned to fit over a top of the wearer's head, side sections positioned to hang adjacent sides of the wearer's head, a back section positioned to hang adjacent a back of the wearer's head, and inner and outer bibs positioned to cover the neck and at least a portion of the shoulders of the wearer. The hood body defines an interior space for receiving the wearer's head. An outlet is provided for exhausting gas from the interior space of the hood body. The outlet includes a channel defined between the inner and outer bibs of the hood body. The channel is in fluid communication with the interior space and includes an open end portion in fluid communication with the environment for exhausting gas from the channel into the environment.

DETAILED DESCRIPTION OF THE INVENTION

Figure 1:
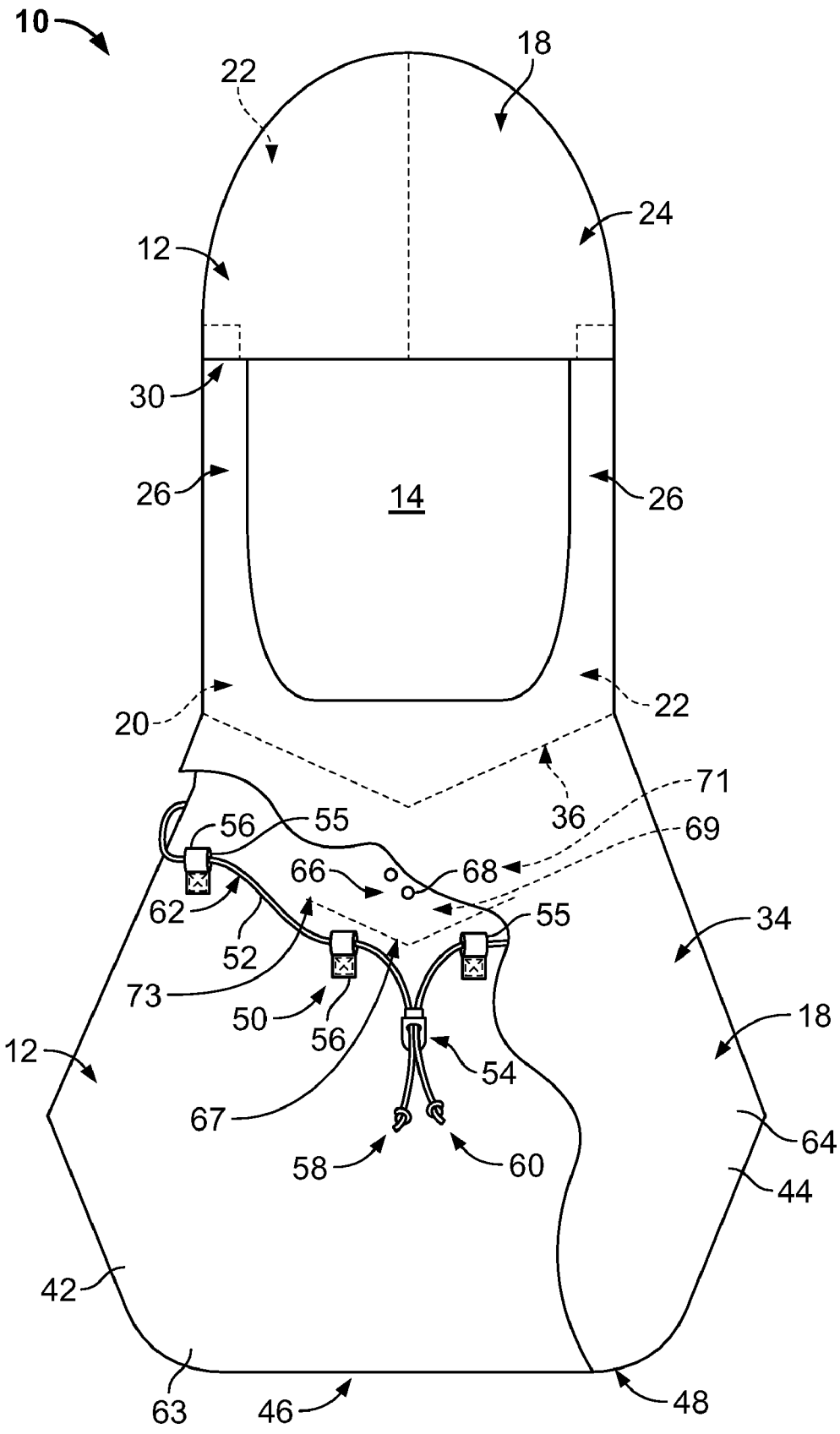
FIG. 1 is a partially broken-away front view of an exemplary embodiment of a protective hood for protecting a wearer's head from environmental elements.
Figure 2:
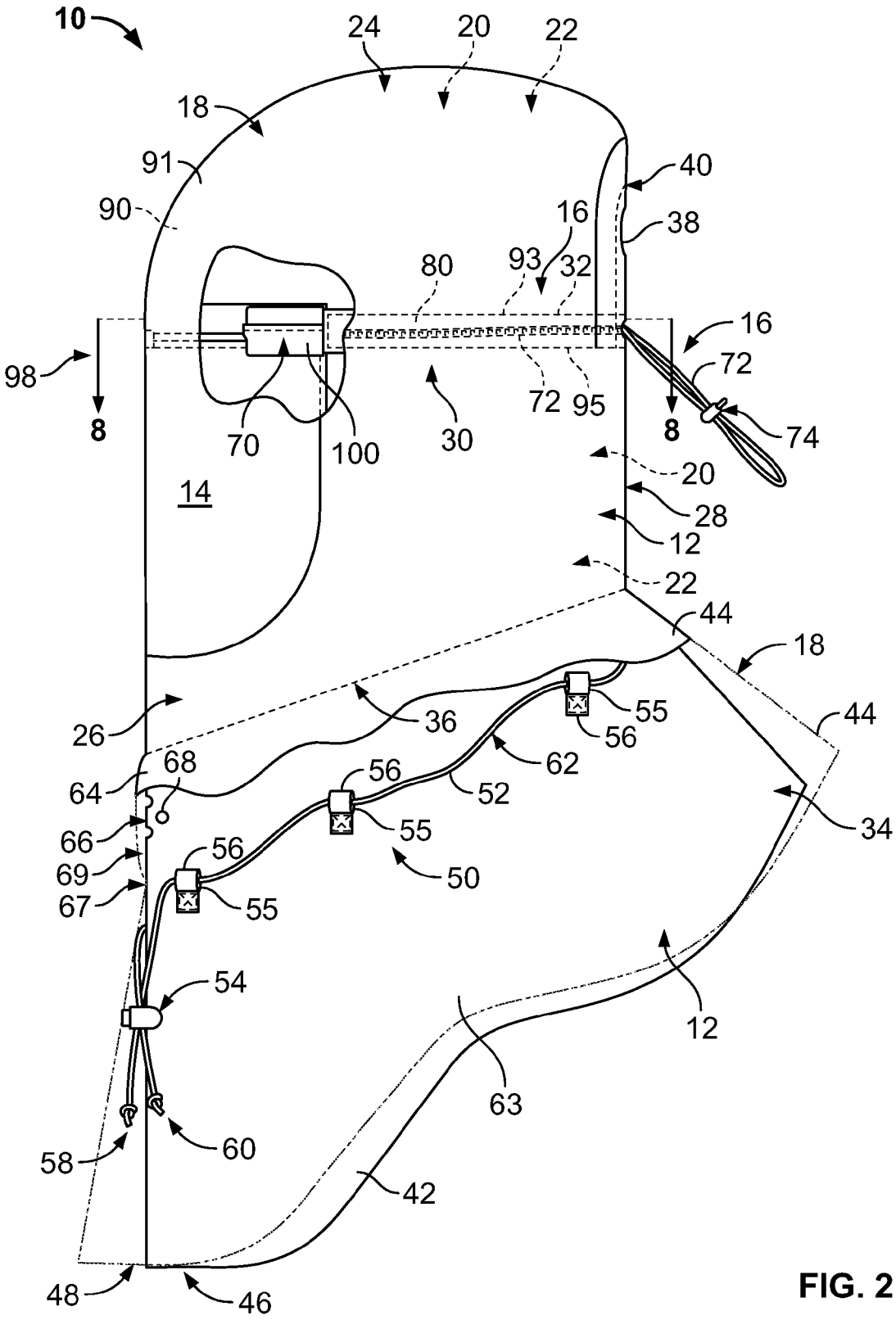
FIG. 2 is a partially broken-away side view of the protective hood shown in FIG. 1.
Figure 3:
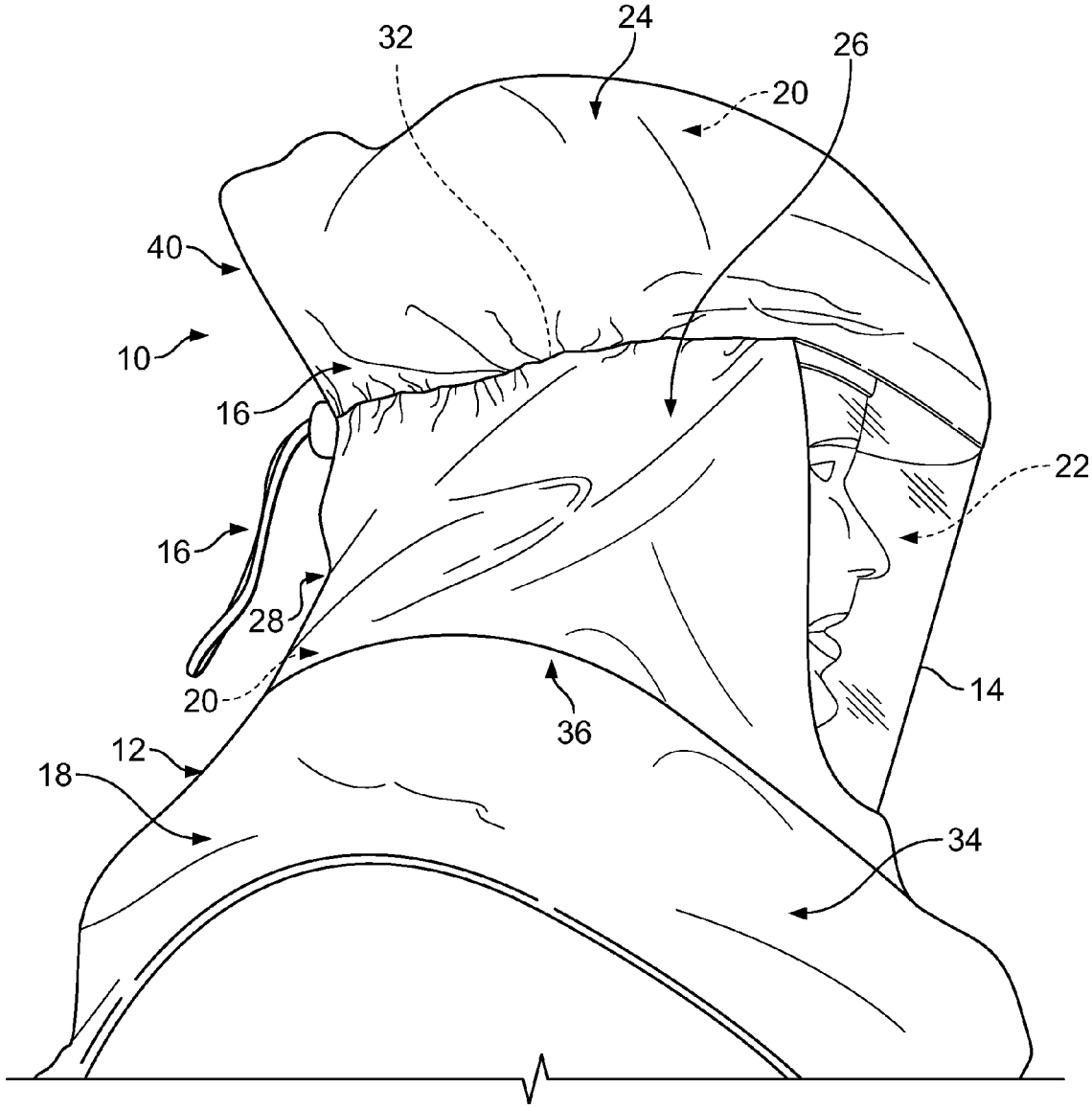
FIG. 3 is a side perspective view of the protective hood shown in FIGS. 1 and 2 illustrating the protective hood donned on a wearer's head.

FIG. 1 is a partially broken-away front view of an exemplary embodiment of a protective hood 10 for protecting a wearer's head from environmental elements. FIG. 2 is a partially broken-away side view of the protective hood 10. FIG. 3 is a side perspective view of the protective hood 10 illustrating the protective hood 10 donned on a wearer's head. The protective hood 10 includes a hood body 12, a transparent face member 14 held by the hood body 12 for enabling the wearer to view the environment while wearing the protective hood 10, and an adjustable head harness assembly 16 held by the hood body 12 for securing the protective hood 10 on the wearer's head. The hood body 12 includes an exterior side portion 18 and an interior side portion 20. The interior side portion 20 defines an interior space 22 of the hood body 12 that receives the wearer's head therein. The face member 14 is held by the hood body 12 in a sealed arrangement such that gas from the environment cannot enter the interior space 22 of the hood body 12 through the interface between the face member 14 and the hood body 12. The hood body 12 includes a cap section 24 positioned to fit over the top of the wearer's head, a pair of opposite side sections 26 positioned to hang adjacent sides of the wearer's head, and a back section 28 positioned to hang adjacent a back of the wearer's head. The side and back sections 26 and 28, respectively, extend from the cap section 24 along an interface 30. As will be described in more detail below, the hood body 12 includes a channel 32 that, in the exemplary embodiment, extends along at least a portion of the interface 30. Optionally, the hood body 12 may include a bib section 34 for covering the neck and at least a portion of the shoulders, arms, and/or torso of the wearer. The bib section 34 extends from the side and back sections 26 and 28, respectively, along an interface 36.

Figure 4:
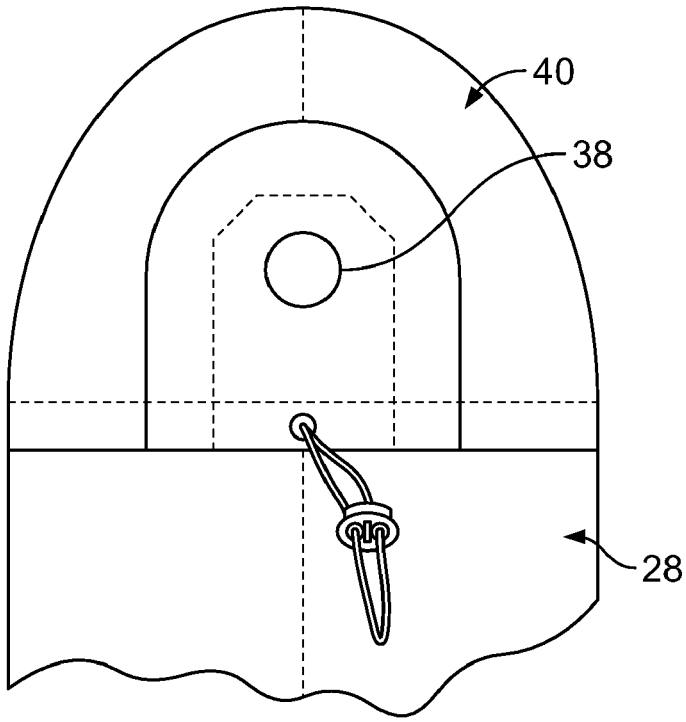
FIG. 4 is a rear view of a portion of the protective hood shown in FIGS. 1-3.

As shown in FIGS. 2 and 4, the hood body 12 includes an inlet 38 for receiving breathable gas into the interior space 22 such that the wearer can breathe while wearing the protective hood 10. The inlet 38 may be supplied with breathable gas from any suitable positive breathing gas supply, such as, but not limited to, a powered air-purifying respirator (PAPR, not shown) fluidly coupled to the inlet 38 and/or from a pressurized source (not shown) of breathing gas using a conduit (not shown) fluidly coupled to the source and the inlet 38. When a PAPR is fluidly coupled to the inlet 38, a blower (not shown) may be used to force breathing gas from the environment through a filter (not shown) and the inlet 38. The filter may be carried by the hood body 12 and directly coupled to the inlet 38 or may be remote from the hood body 12 and coupled to the inlet 38 through a conduit (not shown). The pressurized source may be any suitable source capable of supplying breathing gas to the interior space 22, such as, but not limited to, a source (such as, but not limited to, a tank) carried by the wearer or a source that is remote from the wearer. In the exemplary embodiment, the inlet 38 is located within the cap section 24 at a rear portion 40 thereof. However, the inlet 38 may be located anywhere on the hood body 12 that enables the inlet 38 to function as described herein. In some embodiments, the inlet 38 and an outlet 66 of the hood 10 are positioned on the hood body 12 relative to each other such that flow of the breathing gas is directed across the oral/nasal region of the wearer.

As shown in FIGS. 1 and 2, in the exemplary embodiment, the bib section 34 includes an inner bib 42 and an outer bib 44 (for clarity, the outer bib 44 is partially broken-away in FIGS. 1 and 2). Alternatively, the bib section 34 may include only the inner bib 42 or the outer bib 44. Each of the inner and outer bibs 42 and 44, respectively, may having any suitable size and/or shape, whether the same or different. In the exemplary embodiment, the inner and outer bibs 42 and 44, respectively, extend approximately the same length as measured from the interface 36 to a respective lower front end portion 46 and 48. Alternatively, the inner and outer bibs 42 and 44, respectively, may extend different lengths at the front end portions 46 and 48. The inner and outer bibs 42 and 44, respectively, may each have any suitable length (at any portion(s) thereof and relative to each other or otherwise) that enables the bib section 34 to function as described herein. For example, the inner and outer bibs 42 and 44, respectively, may each have a length that is designed to cover the neck and a desired amount of the wearer's shoulders, arms, and/or shoulders. In some embodiments, the inner bib 42 and/or the outer bib 44 may be tucked into a protective suit (not shown) worn by the wearer to facilitate sealing the protective hood 10 with the protective suit.

As shown in FIGS. 1 and 2, the protective hood 10 optionally includes a neck seal assembly 50 that facilitates at least partially sealing the hood body 12 with the wearer's neck to at least partially restrict fluid flow between the interior space 22 of the hood body 12 and an interior space of the protective suit or to seal the interior space of the hood body 12 from the environment when the wearer is not wearing the protective suit. In the exemplary embodiment, the neck seal assembly 50 includes a drawstring 52 held by the hood body 12, and a cord lock 54. The drawstring 52 is received within the openings 55 of a plurality of retaining members 56 of the hood body 12 to hold the drawstring 52 on the hood body 12. The drawstring 52 includes a pair of opposite end portions 58 and 60 and an intermediate portion 62 extending between the end portions 58 and 60. The drawstring 52 is held on the hood body 12 such that when the end portions 58 and 60 are held adjacent one another, the drawstring 52 completely surrounds the hood body 12. The cord lock 54 is operatively connected to the drawstring 52 to initially hold the end portions 58 and 60 adjacent one another. Specifically, in the exemplary embodiment the cord lock 54 includes a pair of openings (not shown) that each receive a corresponding portion of the drawstring 52. Initially, a corresponding one of the end portions 58 and 60 of the drawstring 52 is inserted within each of the two openings of the cord lock 54. The cord lock 54 is movable along the drawstring 52 away from the end portions 58 and 60 to tighten the drawstring 52, and thus the hood body 12, around the wearer's neck. The cord lock 54 includes an engagement member (not shown) that is selectively engageable with the drawstring 52 to clamp the cord lock 54 to the drawstring 52 and thereby maintain a position of the cord lock 54 along the drawstring 52 (thereby maintaining the tightness of the drawstring 52 about the wearer's neck). In the exemplary embodiment, the engagement member is biased toward engagement with the drawstring 52. In an alternative embodiment, the cord lock 54 includes a single opening that receives both of two portions of the drawstring 52. Optionally, the drawstring 52 may be elastic to facilitate maintaining a secure seal between the hood body 12 and the wearer's neck.

The neck seal assembly 50 may completely seal the protective hood 10 with the wearer's neck such that the neck seal assembly 50 is configured to prevent any fluid flow between the interior space 22 of the hood body 12 and the environment and/or the interior space of the protective suit. Alternatively, the neck seal assembly 50 only partially seals the protective hood 10 with the wearer's neck such that the neck seal assembly 50 is configured to restrict fluid flow between the interior space 22 of the hood body 12 and the environment and/or the interior space of the protective suit. When the neck seal assembly 50 only partially seals the protective hood 10 with the wearer's neck, in some embodiments a pressure of breathable gas within the interior space 22 of the hood body 12 prevents fluid from the environment or the interior space of the protective suit from entering the interior space 22 of the hood body 12. Whether the neck seal assembly 50 completely or partially seals with the wearer's neck may depend on how tight the drawstring 52 is tightened around the wearer's neck.

In the exemplary embodiment, the retaining members 56 are located on an exterior surface 63 of the inner bib 42 such that the drawstring 52 is held between the inner and outer bibs 42 and 44, respectively. Alternatively, the drawstring 52 may be held on an exterior surface 64 of the outer bib 44. Moreover, although in the exemplary embodiment the neck seal assembly 50 is located on the bib section 34 of the hood body 12, the neck seal assembly 50 may be located anywhere on the hood body 12 that enables the neck seal assembly 50 to function as described herein.

Although the neck seal assembly 50 includes the drawstring 52 and the cord lock 54 in the exemplary embodiment, the neck seal assembly 50 may include any suitable structure, mechanism, means, and/or the like that enables the neck seal assembly 50 to function as described herein. Examples of other suitable structure, mechanism, and/or means for the neck seal assembly include, but are not limited to, an elastic band extending completely around the hood body 12, a belt and buckle arrangement, a zip-tie arrangement, a neckband and ratchet assembly for adjusting the size of the neck band, a string that is tied around the hood body 12, and/or the like. Similarly, in addition or alternative to the exemplary structure, mechanism, and means, the cord lock 54 may include any suitable structure, mechanism, means, and/or the like that enables the cord lock 54 to function as described herein. Although in the exemplary embodiment the drawstring 52 is held on hood body 12 using a plurality of retaining members 56, alternatively the drawstring 52 may be held on the hood body 12 by a single contiguous channel (not shown) extending along the hood body 12.

Figure 5:
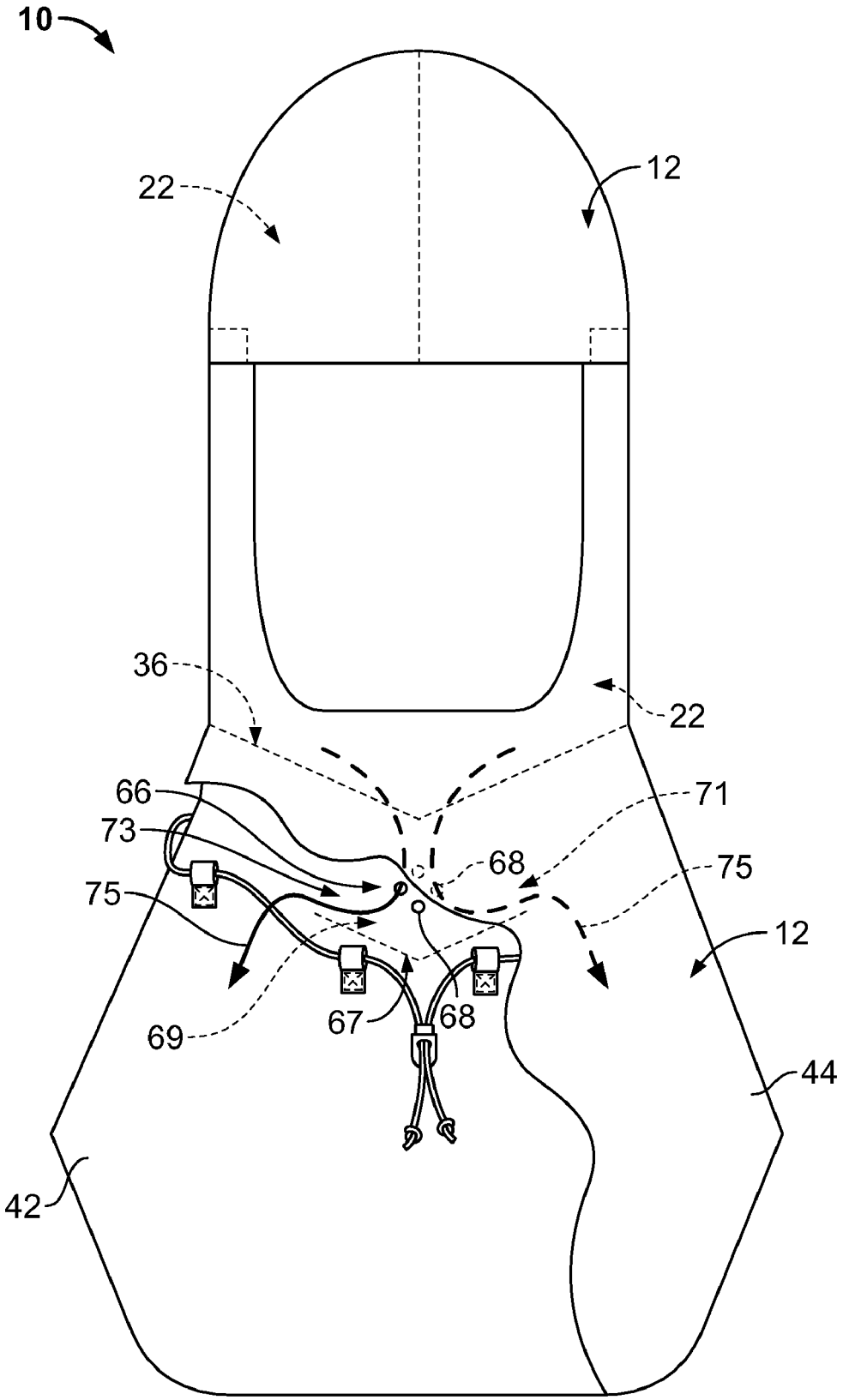
FIG. 5 is another partially broken-away front view of the protective hood shown in FIGS. 1-3.

Referring now to FIGS. 1, 2, and 5, the hood body 12 includes the outlet 66 for discharging gas, including breathing gas that has been breathed by the wearer and any gas that has not been breathed by the wearer, from the interior space 22 of the hood body 12. The outlet 66 includes a plurality of openings 68 that extend through the inner bib 42. Portions of the inner and outer bibs 42 and 44, respectively, are attached together, as indicated by the reference numeral 67, to form a channel 69 defined between the inner and outer bibs 42 and 44, respectively. The channel 69 extends between a pair of open end portions 71 and 73 and between the attachment point 67 and the interface 36, where the inner and outer bibs 42 and 44, respectively, meet. The channel 69 is in fluid communication with the interior space 22 via the openings 68 and is in fluid communication with the environment via the open end portions 71 and 73.

In operation, and as shown in FIG. 5 by the arrows 75, gas within the interior space 22 of the hood body 12 is discharged therefrom by flowing through the openings 68 and into the channel 69. The gas then flows out of the open end portions 71 and 73 of the channel 69 and exhausts to the environment by flowing between the inner and outer bibs 42 and 44, respectively. The channel 69 holds a dead space volume of breathable gas therein between the inner and outer bibs 42 and 44, respectively, and restricts back flow of gas from the environment through the outlet 66 and into the interior space 22 of the hood body 12. For example, when a negative pressure is created on the interior side (within the interior space 22) of the outlet openings 68, for example by movement or inhalation of the wearer, only the volume of breathable gas contained within the channel 69 will be drawn through the outlet openings 68 and into the interior space 22, rather than gas from the environment. Negative pressures on the interior side of the outlet openings 68 that are large enough draw gas from the environment into the channel 69 will cause the channel 69 to collapse and thereby seal the outlet openings 68, as well as the interior space 22, from the environmental gas.

The size, shape, volume, and/or the like of the channel 69, as well as the number, size, shape, pattern, configuration, and/or the like of the openings 68, may be selected to enable the outlet 66 to function as described herein. The channel 69 may have any size, shape, volume, and/or the like that enables the outlet 66 to function as described herein. Although the location of the outlet 66 with respect to the inner and outer bibs 42 and 44, respectively, is specifically shown in the exemplary embodiment, the outlet 66 may be located anywhere on the hood body 12, for example with respect to the inner bib 42 and/or the outer bibs 44, that enables the outlet 66 to function as described herein. In some embodiments, the inlet 38 and an outlet 66 of the hood 10 are positioned on the hood body 12 relative to each other such that flow of the breathing gas is directed across the oral/nasal region of the wearer. Although two openings 68 are shown in FIG. 1, three openings 68 are shown in FIG. 2, and four openings 68 are shown in FIG. 5, the outlet 66 may include any number of openings 68, each having any size, shape, and/or the like, that enables the outlet 66 to function as described herein. Moreover, the openings 68 may have any suitable pattern that enables the outlet 66 to function as described herein. In the exemplary embodiment, the channel 69 is open at both of the end portions 71 and 73. Alternatively, the channel 69 is open at only one of the end portions 71 or 73. The attachment 67 between the inner and outer bibs 42 and 44, respectively, that forms the channel 69 may be formed using any suitable structure, method, means, and/or the like, such as, but not limited to, sewing, stapling, laminating, using an adhesive, and/or the like.

Figure 6:
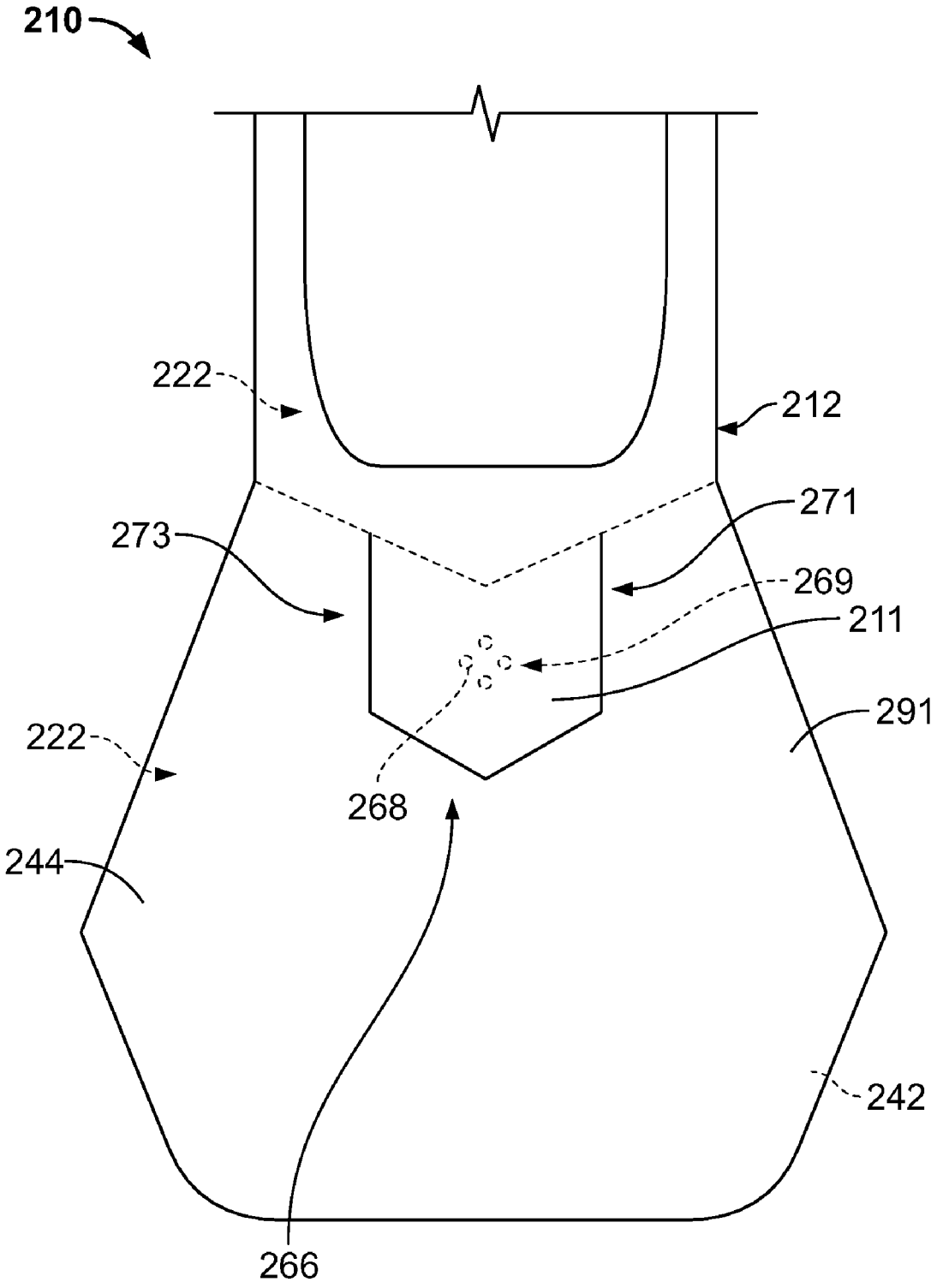
FIG. 6 is a front view of a portion of an exemplary alternative embodiment of a protective hood.

FIG. 6 is a front view of a portion of an exemplary alternative embodiment of a protective hood 210. In alternative to the exemplary channel 69 (FIGS. 1, 2, and 5) that is defined between the inner bib 42 (FIGS. 1, 2, and 5) and the outer bib 44 (FIGS. 1, 2, and 5), a hood body 212 of the protective hood 210 includes an outlet 266 having a flap 211 that is attached to the hood body 212 to form a channel 269 between the flap 211 and an exterior surface 291 of an outer bib 244 of the hood body 212. The channel 269 includes one or more open end portions 271 and/or 273 in fluid communication with the environment and is in fluid communication with an interior space 222 of the hood body 212 via one or more openings 268 within the hood body 212. In the embodiment shown in FIG. 6, the hood body 212 includes an inner bib 242 and the openings 268 extend through the inner and outer bibs 242 and 244, respectively. Alternatively, the hood body 212 does not include the inner bib 242.

Figure 7:
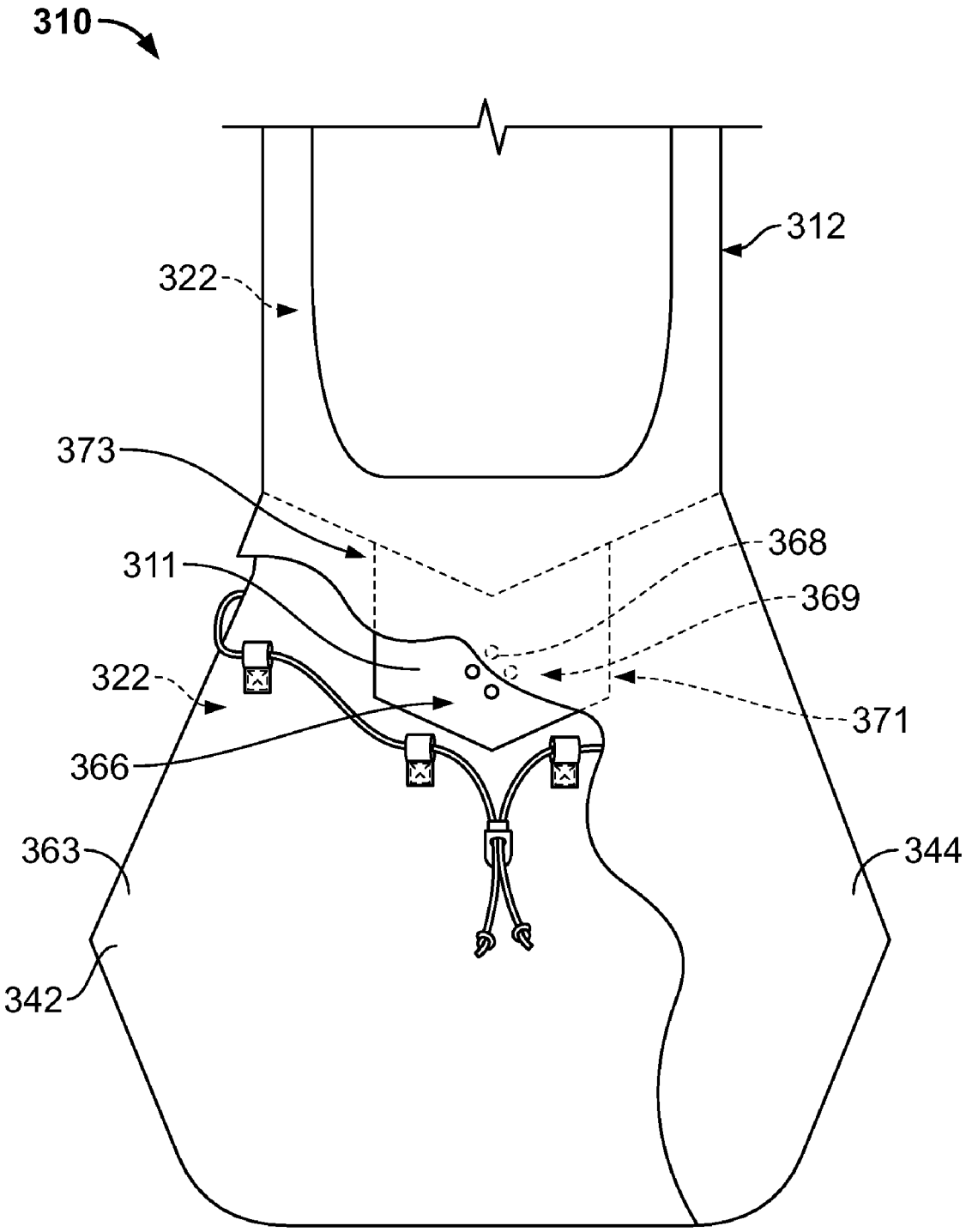
FIG. 7 is a partially broken-away front view of a portion of an exemplary alternative embodiment of a protective hood.

FIG. 7 is a partially broken-away front view of a portion of an exemplary alternative embodiment of a protective hood 310. In alternative to the exemplary channel 69 (FIGS. 1, 2, and 5) that is defined between the inner bib 42 (FIGS. 1, 2, and 5) and the outer bib 44 (FIGS. 1, 2, and 5), a hood body 312 of the protective hood 310 includes an outlet 366 having a flap 311 that is attached to the hood body 312 to form a channel 369 between the flap 311 and an exterior surface 363 of an inner bib 342 of the hood body 312. The channel 369 includes one or more open end portions 371 and/or 373 in fluid communication with the environment and is in fluid communication with an interior space 322 of the hood body 312 via one or more openings 368 within the inner bib 342. In the embodiment shown in FIG. 7, the hood body 312 includes an outer bib 344. Alternatively, the hood body 312 does not include the outer bib 344.

Figure 8:
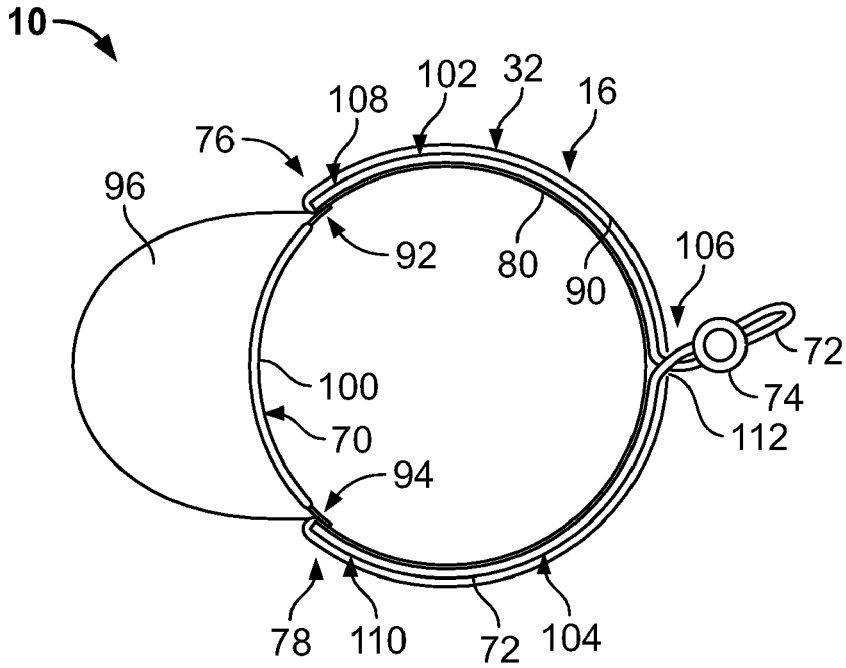
FIG. 8 is a cross sectional view of the protective hood shown in FIGS. 1-3 taken along line 8-8 of FIG. 2.

FIG. 8 is a cross sectional view of the protective hood 10 taken along line 8-8 of FIG. 2. Referring now to FIGS. 2 and 8, the adjustable head harness assembly 16 includes a headband 70, an elastic member 72, and a cord lock 74. As briefly described above, the hood body 12 includes a channel 32 that, in the exemplary embodiment, extends along the interface 30 between the cap section 24 and the side and back sections 26 and 28, respectively, of the hood body 12. Accordingly, in the exemplary embodiment the channel 32 is positioned to extend along the sides and back of the wearer's head above a level of the wearer's eyes. The channel 32 extends between a pair of opposite end portions 76 and 78. In the exemplary embodiment, the channel 32 extends on the interior side portion 20 of the hood body 12. Alternatively, the channel 32 extends on the exterior side portion 18 of the hood body 12. In the exemplary embodiment, the channel 32 is formed by a portion 80 of the cap section 24 that overlaps the interior side portion 20 of the side and back portions 26 and 28, respectively, and is connected to an interior surface 90 of the hood body 12 at the side and back portions 26 and 28, respectively. Specifically, opposite side portions 93 and 95 of the portion 80 are connected to the interior surface 90 to define the channel 32 therebetween. Alternatively, the portion 80 of the cap section 24 that forms the channel 32 overlaps the exterior side portion 18 of the side and back portions 26 and 28, respectively and is connected to an exterior surface 91 of the hood body 12 at the side and back portions 26 and 28, respectively. Another example of forming the channel 32 includes connecting a strip of material (not shown) that has a pair of opposite end portions and a pair of opposite side portions, wherein the side portions are each connected to the interior surface 90 or exterior surface 91 of the hood body 12 along at least a portion of the length of the strip such that the channel 32 is formed between the strip 80 and the interior surface 90 or exterior surface 91 of the hood body 12. Optionally, the channel 32 may be closed at the end portions 76 and 78 thereof. The channel 32 may have any suitable size and shape that enables the channel 32 to receive, as described below, the elastic member 72 therein. Portions of the hood body 12 defining the channel (such as, but not limited to, the portion 80 of the cap section 24 or the strip of material) may be connected to interior surface 90 or exterior surface 91 of the hood body 12 using any suitable method, structure, mechanism, means, and/or the like that enables the channel 32 to function as described herein, such as, but not limited to, stitching, sewing, weaving, using an adhesive, and/or the like.

As discussed above, in an alternative embodiment the channel 32 extends on the exterior side portion 18 of the hood body 12 rather than the interior side portion 20. Although the channel 32 extends along the interface 30 in the exemplary embodiment, the channel 32 may be located anywhere along the hood body 12 that enables the adjustable head harness assembly 16 to function as described herein. For example, the channel 32 may extend along at least a portion of the side and back sections 26 and 28, respectively, of the hood body 12 such that at least a portion of the channel 32 is positioned to extend along at least a portion of the sides and/or back of the wearer's below a level of the wearer's eyes. Accordingly, in some embodiments at least a portion of the channel 32 may be positioned to extend over the wearer's ears, below the wearer's ears, along a base of the back of the wearer's head, and/or along a top of the back of the wearer's neck. Moreover, although in the exemplary embodiment the channel 32 extends generally along the entirety of the interface 30, the channel 32 may alternatively extend along only a portion of the interface 30.

The headband 70 extends between a pair of opposite end portions 92 and 94. The headband 70 is held within the interior space 22 of the hood body 12 and is positioned to engage the wearer's forehead when the wearer is wearing the protective hood 10. Specifically, in the exemplary embodiment the end portions 92 and 94 of the headband 70 are connected to the portion 80 defining the channel 32 such that the headband 70 extends from the end portion 76 of the channel 32 to the end portion 78 of the channel 32. In addition or alternative to holding the headband 70 within the interior space 22 by connecting the headband 70 to the portion 80, a visor 96 may interconnect the headband 70 to an upper end portion 98 of the face member 14. In addition to supporting the headband 70, the visor 96 may also facilitate spacing the face member 14 from the wearer's face when the wearer is wearing the protective hood 10. Spacing the face member 14 from the wearer's face may facilitate expelling gas from the interior space 22 of the hood 10 and/or provide room for additional eye protection, such as, but not limited to, goggles (not shown). The headband 70 may optionally include an absorbent material 100 on a surface thereof to facilitate absorbing sweat from the wearer's forehead.

The headband 70 may be connected to the portion 80 defining the channel 32 using any suitable method, structure, mechanism, means, and/or the like that enables the headband 70 to function as described herein, such as, but not limited to, stitching, sewing, using an adhesive, using a threaded fastener, using a rivet, using a snap, and/or the like. Similarly, the visor 96 may be connected to headband 70 and the face member 14 using any suitable method, structure, mechanism, means, and/or the like that enables the headband 70 and the face member 14 to function as described herein, such as, but not limited to, using an adhesive, using a threaded fastener, using a rivet, using a snap, using an interference fit, and/or the like. In addition or alternative to the exemplary arrangement, configuration, structure, mechanism, and means, the headband 70 may be held within the interior space 22 of the hood body 12 using any suitable arrangement, configuration, structure, mechanism, means, and/or the like that enables the headband 70 to function as described herein.

The elastic member 72 extends through the channel 32 such that, in the exemplary embodiment, a portion of the elastic member 72 extends on the interior side portion 20 of the hood body 12 along the interface 30 between the cap section 24 and the side and back sections 26 and 28, respectively, of the hood body 12. Accordingly, in the exemplary embodiment a portion of the elastic member 72 is positioned to extend along the sides and back of the wearer's head above a level of the wearer's eyes. The elastic member 72 includes a pair of opposite portions 102 and 104 that each extend within the channel 32 and a portion 106 that extends between the portions 102 and 104. The portion 102 includes an end portion 108 and the portion 104 includes an end portion 110 that is opposite the end portion 108. The end portions 108 and 110 are connected to hood body 12. The portion 106 extends outside of the channel 32 on the exterior side portion 18 of the hood body 12. Specifically, the elastic member 72 extends through an opening 112 within the hood body 12 that communicates with the channel 32 to expose the channel to the exterior side portion 18 of the hood body 12. The opening 112 enables the elastic member portion 106 to extend outside the channel 32 on the exterior side portion 18 of the hood body 12. In the exemplary embodiment, the opening 112 is within the back section 28 of the hood body 12. However, the opening 112 may be located anywhere on the hood body 12 that enables the opening to expose the channel 32 to the exterior side portion 18 of the hood body 12 such that a portion of the elastic member 72 extends outside of the channel 32 on the exterior side portion 18.

The elastic member portions 102 and 104 may each be referred to herein as a "first portion" and as a "second portion". The elastic member portion 106 may be referred to herein as a "second portion" and as a "third portion". The end portions 108 and 110 of the elastic member 72 may be connected to hood body 12 using any suitable method, structure, mechanism, means, and/or the like that enables the elastic member 72 to function as described herein, such as, but not limited to, stitching, sewing, weaving, using an adhesive, and/or the like. In the exemplary embodiment, the elastic member 72 has an approximately circular cross section such that the elastic member has a cylindrical cord shape. However, the elastic member 72 may have any suitable shape that enables the adjustable head harness assembly 16 to function as described herein, such as, but not limited to, a square or rectangular cross section such that the elastic member 72 has a ribbon and/or band shape, and/or the like.

In the exemplary embodiment, the material of the hood body 12 that defines the channel 32, including the strip 80, completely surrounds the circumference of the portions 102 and 104 of the elastic member 72 that extend through the channel 32. Accordingly, the elastic member 72 is isolated from the interior space 22 of the hood body 12 such that the elastic member 72 does not contact the wearer's head when the wearer is wearing the protective hood 10. Alternatively, the channel 32 is formed by a plurality of spaced apart channel sections (similar to the retaining members 56) such that portions of the elastic member portions 102 and 104 are exposed to the interior space 22 of the hood body 12.

As described above, in an alternative embodiment the channel 32 extends on the exterior side portion 18 of the hood body 12 rather than the interior side portion 20. In such an alternative embodiment, the portions 102 and 104 of the elastic member 72 also extend on the exterior side portion 18 of the hood body 12 rather than the interior side portion 20 and are therefore isolated from the interior space 22 of the hood body 12. Although the channel 32 and therefore the elastic member portions 102 and 104 extend along the interface 30 in the exemplary embodiment, the elastic member portions 102 and 104 may be located anywhere along the hood body 12 that enables the adjustable head harness assembly 16 to function as described herein. For example, the channel 32 and therefore the elastic member portions 102 and 104 may extend along at least a portion of the side and back sections 26 and 28, respectively, of the hood body 12 such that at least a portion of the elastic member portions 102 and 104 are positioned to extend along at least a portion of the sides and/or back of the wearer's below a level of the wearer's eyes. Accordingly, in some embodiments at least a portion of the elastic member portions 102 and 104 may be positioned to extend over the wearer's ears, below the wearer's ears, along a base of the back of the wearer's head, and/or along a top of the back of the wearer's neck. Moreover, although in the exemplary embodiment the channel 32 and therefore the elastic member portions 102 and 104 extend generally along the entirety of the interface 30, the elastic member portions 102 and 104 may alternatively extend along only a portion of the interface 30.

The cord lock 74 is operatively connected to the elastic member 72 for adjusting and maintaining an amount of tension of the elastic member 72. Specifically, in the exemplary embodiment the cord lock 74 includes a pair of openings (not shown) that each receives a corresponding portion of the elastic member portion 106. The cord lock 74 is movable along the elastic member portion 106 toward the hood body 12 to tighten the elastic member 72, and thus the hood body 12, around the wearer's head. It should be understood that as the elastic member 72 is tightened about the wearer's head, portions of the elastic member portions 102 and 104 may move out of the channel 32 through the opening 112 and extend on the exterior side portion 18 of the hood body 12. The cord lock 74 includes an engagement member (not shown) that is selectively engageable with the elastic member 72 to clamp the cord lock 74 to the elastic member 72 and thereby maintain a position of the cord lock 74 along the elastic member 72 (thereby maintaining the tension and tightness of the elastic member about the wearer's head). In the exemplary embodiment, the engagement member is biased toward engagement with the elastic member 72. In an alternative embodiment, the cord lock 74 includes a single opening that receives two portions of the elastic member portion 106. In addition or alternative to the exemplary structure, mechanism, and means, the cord lock 74 may include any suitable structure, mechanism, means, and/or the like that enables the cord lock 74 to function as described herein.

In operation, the wearer dons the protective hood 10 by placing the hood body 12 over the wearer's head and pulling the hood body 12 downward such that the wearer's head is received within the interior space 22 of the hood body 12. The wearer disengages the engagement member of the cord lock 74 from the elastic member 72 and moves the cord lock 74 along the elastic member portion 106 toward the hood body 12 to tighten the elastic member 72 about the wearer's head until the protective hood has a secure and comfortable fit on the wearer's head. The engagement member of the cord lock 74 is then engaged with the elastic member 72 to maintain the tension and tightness of the elastic member 72 about the wearer's head. The wearer may also tighten the neck seal assembly 50 in a similar fashion to the adjustable head harness assembly 16 by tightening the drawstring 52 using the cord lock 54 until the wearer has a secure and comfortable seal between the wearer's neck and the bib section 34. In addition or alternative to using the neck seal assembly 50, the wearer may tuck the inner bib 42 (and sometimes the outer bib 44 as well) into a protective suit worn by the wearer. In some embodiments, the source of breathing gas is fluidly coupled to the inlet 38 before donning of the protective hood 10 such that the interior space 22 is provided with breathable gas before the wearer dons the protective hood 10.

The hood body 12 may be fabricated from any suitable material(s) that enable the hood body 12 to function as described herein, such as, but not limited to, polyvinyl chloride (PVC), Kevlar®, Nomex®, Tychem®, self-extinguishing materials, flame retardant materials, gas-impermeable materials, liquid-impermeable materials, particulate-impermeable materials, and/or the like. The hood body 12 may be configured to protect against any suitable contaminants, such as, but not limited to, chemical, biological, radiological, and/or nuclear (CBRN) contaminants. The cap section 24, the strip 80, the side sections 26, the back section 28, and/or the bib section 34 of the hood body 12 may be integrally formed or may be formed separately and thereafter attached together using any suitable method, structure, mechanism, means, and/or the like.

The face member 14 may be fabricated from any suitable material(s) that enable the face member 14 to function as described herein, such as, but not limited to, glass, nylon, polyester plastic, polyvinyl chloride (PVC), urethane, polycarbonate, and/or the like. As used herein, the phrase "transparent face member" means that the face member 14 is at least partially transparent to visible light such that the wearer of the protective hood 10 can view the wearer's environment through the face member 14 when the wearer is wearing the protective hood 10.

The elastic member 72 may be fabricated from any suitable material(s) that enable the adjustable head harness assembly 16 to function as described herein, such as, but not limited to, latex, Lycra®, and/or the like. In some alternative embodiments, the elastic member 72 is not elastic and therefore functions like a drawstring.

In an alternative embodiment, the protective hood 10 does not include the headband 70, but instead, the elastic member 72 may form a continuous loop such that a portion of the elastic member 72 extends along the entirety of the circumference of the hood body 12. Optionally, in such an alternative embodiment wherein a portion of the elastic member 72 extends along the entirety of the circumference of the hood body 12, the channel may also extend along the entirety of the circumference of the hood body 12.

The embodiments described herein provide a protective hood that includes an outlet that may be less expensive than at least some known protective hood outlets. The embodiments described herein provide a protective hood that includes an outlet that may prevent contaminated ambient gas from entering an interior space of the protective hood through the outlet.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A protective hood for protecting a wearer's head from environmental elements, said protective hood comprising:

a hood body comprising a cap section positioned to fit over a top of the wearer's head, side sections positioned to hang adjacent sides of the wearer's head, and a back section positioned to hang adjacent a back of the wearer's head, the hood body defining an interior space for receiving the wearer's head;

an outlet for exhausting gas from the interior space of the hood body, the outlet comprising a channel defined by inner and outer bibs of the hood body, the channel being in fluid communication with the interior space and comprising an open end portion in fluid communication with the environment for exhausting gas from the channel into the environment, wherein the channel is configured to hold a dead space volume of gas.

2. The protective hood according to claim 1, wherein the open end portion is a first open end portion, the channel extending between the first open end portion and a second open end portion that is opposite the first open end portion.

3. The protective hood according to claim 1, wherein the hood body further comprises an opening extending through the inner bib of the hood body, the opening fluidly connecting the channel to the interior space.

4. The protective hood according to claim 1, further comprising an inlet within the hood body for receiving a flow of breathing gas within the interior space.

5. The protective hood according to claim 1, wherein the hood body comprises at least one of a gas-impermeable material, a liquid-impermeable material, and a particulate-impermeable material.

6. The protective hood according to claim 1, wherein the channel extends a length from the open end portion to an opposite open end portion, the length of the channel being configured to extend transversely across the wearer's head.

7. The protective hood according to claim 1, wherein the channel is configured to collapse upon a predetermined negative pressure occurring within the interior space.

8. A protective hood for protecting a wearer's head from environmental elements, said protective hood comprising:

a hood body comprising a cap section positioned to fit over a top of the wearer's head, side sections positioned to hang adjacent sides of the wearer's head, a back section positioned to hang adjacent a back of the wearer's head, and inner and outer bibs positioned to cover the neck and at least a portion of the shoulders of the wearer, the hood body defining an interior space for receiving the wearer's head; and an outlet for exhausting gas from the interior space of the hood body, the inner and outer bibs being attached together at two separate locations to define a channel between the inner and outer bibs of the hood body, the channel being in fluid communication with the interior space and comprising an open end portion in fluid communication with the environment for exhausting gas from the channel into the environment.

9. The protective hood according to claim 8, wherein the open end portion is a first open end portion, the channel extending between the first open end portion and a second open end portion that is opposite the first open end portion.

10. The protective hood according to claim 8, wherein the hood body further comprises an opening extending through the inner bib of the hood body, the opening fluidly connecting the channel to the interior space.

11. The protective hood according to claim 8, further comprising a neck seal assembly for sealing the interior space of the hood body when the wearer is wearing the protective hood.

12. The protective hood according to claim 8, wherein the hood body comprises at least one of a gas-impermeable material, a liquid-impermeable material, and a particulate-impermeable material.

13. The protective hood according to claim 8, further comprising an inlet within the hood body for receiving a flow of breathing gas within the interior space.

14. The protective hood according to claim 8, further comprising a transparent face member held by the hood body.

15. The protective hood according to claim 8, wherein the two separate locations where the inner and outer bibs are attached together comprise an upper boundary and a lower boundary of the channel.

16. The protective hood according to claim 8, wherein the outlet is defined solely by the hood body.

17. A protective hood for protecting a wearer's head from environmental elements, said protective hood comprising:

a hood body comprising a cap section positioned to fit over a top of the wearer's head, side sections positioned to hang adjacent sides of the wearer's head, and a back section positioned to hang adjacent a back of the wearer's head, the hood body defining an interior space for receiving the wearer's head;

an outlet for exhausting gas from the interior space of the hood body, the outlet comprising a channel defined by first and second portions of the hood body, the channel extends a length from an open end portion to an opposite open end portion, the length of the channel being configured to extend transversely across the wearer's head, the channel being in fluid communication with the interior space, the open end portions of the channel being in fluid communication with the environment for exhausting gas from the channel into the environment.

* * * * *